US005562573A

United States Patent [19]

Harinishi

[11] Patent Number: 5,562,573

[45] Date of Patent: Oct. 8, 1996

[54] LANDING MAT FOR GYMNASTS

[76] Inventor: Atsushi Harinishi, 1-21, Wakamiyacho, Izumisanoshi, Osaka, Japan

[21] Appl. No.: 490,773

[22] Filed: Jun. 15, 1995

[30] Foreign Application Priority Data

Jun. 20, 1994 [JP] Japan ..... 6-137245

[51] Int. Cl.[6] ..... A63B 6/00

[52] U.S. Cl. ..... 482/23; 5/420

[58] Field of Search ..... 5/417, 420; 273/DIG. 4, 273/DIG. 8; 482/23, 25, 26

[56] References Cited

U.S. PATENT DOCUMENTS

| | | | |
|---|---|---|---|
| 3,204,259 | 9/1965 | Gordon | 5/420 |
| 3,262,134 | 7/1966 | Bramble | 482/23 |
| 3,636,577 | 1/1972 | Nissen | 482/23 |
| 4,147,828 | 4/1979 | Heckel et al. | 5/420 |
| 4,168,061 | 9/1979 | Gordon | 5/420 |
| 4,350,721 | 9/1982 | Nagase | 5/420 |
| 4,603,852 | 8/1986 | Breitscheidel et al. | 482/23 |
| 5,100,716 | 3/1992 | Juneau | 5/417 |
| 5,212,842 | 5/1993 | Glydon | 482/23 |

FOREIGN PATENT DOCUMENTS

| | | | |
|---|---|---|---|
| 9001355 | 2/1990 | WIPO | 482/23 |

*Primary Examiner*—Richard J. Apley
*Assistant Examiner*—David R. Risley
*Attorney, Agent, or Firm*—Collard & Roe, P.C.

[57] ABSTRACT

A landing mat for gymnasts is composed of a top layer serving as a primary cushion, a middle layer disposed under the top layer so as to stabilize the posture of the gymnasts going to land on their feet, and a bottom layer serving as a main cushion and secured to a lower surface of the middle layer. All the layers are made of plastics foams. The top layer is 10–30 mm thick and has a 25%-compression stiffness of 0.20–0.50 kgf/cm$^2$ and a repelling elasticity of 40–60%. The middle layer is 15–50 mm thick and has a compression stiffness of 1.0–4.0 kgf/cm$^2$. The bottom layer is 50–175 mm thick and has a compression stiffness of 0.040–0.060 kgf/cm$^2$ and a repelling elasticity of 35–50%, such that the International Federation of Gymnasts' (FIG) standards going to be revised in 1995 are satisfied with respect to safety and posture stabilizability for the landing gymnasts.

12 Claims, 3 Drawing Sheets

LANDING MAT FOR GYMNASTS

BACKGROUND OF THE INVENTION

1. Field of the Invention

The present invention relates to a landing mat for use in gymnastic exercises and together with a horizontal bar, parallel bars, uneven bars, a long horse, a pommel horse, flying rings, a balance beam or the like.

2. Technological Background

The mats of this type must be designed to ensure safe landing for gymnasts and assist them not to totter on the mat but to stand still and upright. The first function of ensuring safe landing relies on the capability of absorbing the shock imparted to those who are landing. The second function of helping them to their upright posture is the possibility of evenly receiving a dynamic load so as to prevent any portions of their feet from sinking deeper than the other portions.

These functions may be evaluated using the following three parameters (a)–(c) in combination.

(a) FO-max (viz. 'ef-ou max')

This parameter in the terms of 'N' (viz. newtons) is called the 'shock damping coefficient' or 'maximum break force' for bearing an impact stress loaded on the landing mat. An extremely high FO-max value represents, for example, a landing on a very hard rigid plane, while an extremely low FO max valve corresponds to a flexible net for receiving acrobats. The landing mats are required to have a FO-max value as low as possible to ensure a safe landing for gymnasts.

(b) S-ein (viz. 'es-ain')

This parameter represents the extent of a cave-in of the mat's portion compressed by the impact. A greater value of S-ein will be effective to decrease the FO-max to a certain degree. However, an excessively great S-ein will render it difficult for the landing gymnasts to control in an instant their posture on the mat. Thus, desired is a combination of the smallest possible S-ein value with the lowest possible FO-max.

(c) S-ruck (viz, 'es-rak')

This parameter, which is a measure of springback of the mat having received a downward impact, will be expressed in the term of height to which an object having fallen on the mat is repelled upwards thereby. An extremely small S-ruck will disable the safe landing, whereas an excessively great S-ruck repelling the landing gymnasts makes it difficult for them to instantaneously control their posture on the mat. Although a medium S-ruck may be preferred, any value thereof below a certain upper limit will not be regarded, from a practical point of view, as too small to meet the requirements, if FO-max is included in a moderate range.

The FIG short for International Federation of Gymnasts ('Federation Internationale des Gymnastes') has established the methods of measuring the values of FO-max, S-ein and S-ruck. According to FIG's standard, a landing mat 1000 mm×2000 mm wide is prepared for test and 9 (nine) small regions are marked on this mat. A metal column having a diameter of 10 cm and weighing 20 kg will then be dropped 10 (ten) times onto each region from a height of 80 cm thereabove, thus dropping the column 90 (ninety) times in total. 18 (eighteen) data obtained by the first and second droppings of the column are excluded so that only 72 (seventy-two) data are used to calculate an average for the third to tenth droppings for each region.

A standard landing mat for general use in international gymnastic meetings is prescribed by the FIG as shown in Table 1. The parameters FO-max, S-ein and S-ruck for the landing mat 200 mm thick for male gymnasts are: 3650 N (about 372.19 kgf) or less; 110 mm or less; and 120 mm or less, respectively.

Nowadays, many gymnasts are trying a triple somersault or other difficult performances in horizontal bar or other exercises before landing on a mat. Thus, revision of the existing standards for the landing mats has been discussed for a surer protection of gymnasts. The 'new' severer standards as listed in Table 1 are going to be adopted by the FIG in the near future.

TABLE 1

FIG Standards for Landing Mats

| Thickness | FO-max (N) | | S-ein (mm) | | S-ruck (mm) | |
|---|---|---|---|---|---|---|
| (mm) | Existing | New | Existing | New | Existing | New |
| 120 | 4500 | 4000 | 105 | 105 | 150 | 100 |
| 150 | — | 3500 | — | 105 | — | 100 |
| 180 | 4050 | 3000 | 110 | 110 | 185 | 90 |
| 200 | 3650 | 3000 | 110 | 110 | 120 | 90 |

3. Prior Art

The landing mat, which the present inventors proposed as disclosed in the Japanese Utility Model Publication No. 4-34845, was approved by the FIG and has widely been employed in international gymnastic meetings.

The prior art landing mat consists of a few or more flat units laid one on another, and each unit comprises a relatively hard top layer and a soft bottom layer fixed thereto. The top layer consists of two strata, that is an upper polyethylene foam whose expansion ratio is 20–40 and a lower polyethylene foam whose expansion ratio is 10–20. The bottom layer is of a thickness equal to or less than that of the top layer, and some flat units of this structure may be stacked one over another to be of a required overall thickness and wrapped with a cover sheet.

This mat is however not in conformity with the new FIG standards. Particularly, the new FO-max standard is not met, thus failing to enhance the gymnasts' safe landing.

In effort to lower the FO-max of the prior art mat, the present inventors tried some new materials to be replaced for those included in said mat. It has been confirmed, that the lower the FO-max value, the more unevenly the mat is depressed upon impact. The mat causing an irregular sinking of feet cannot act as any reliable horizontal plane for gymnasts, forcing them to make a surplus effort to stand still on the mat. In addition, some foot portions of the gymnast will extremely depress some areas of such a mat, almost 'colliding' with a hard floor, thus failing to protect him or her from an intolerable shock.

SUMMARY OF THE INVENTION

An object of the present invention made in view of those problems is to provide a landing mat improved such that the capability of safe landing as well as the postural stability on the mat are enhanced for gymnasts, and more particularly improved such that the new FIG standards are met.

In order to achieve the objects, the present inventors employed in the landing mat a three-layer structure, investigated each layer to find out a desirable material and preferable physical properties thereof, and have established this invention. The three layers are: a top layer serving as a primary cushion for gymnasts; a middle layer disposed under the top layer and stabilizing the posture of the gymnasts having landed on the mat; and a bottom layer serving as a main cushion and secured to a lower surface of the middle layer.

In accordance with the present invention, a landing mat for gymnasts comprises: a top layer serving as a primary cushion; a middle layer disposed under the top layer so as to stabilize the posture of the gymnasts landing on their feet; and a bottom layer serving as a main cushion and secured to a lower surface of the middle layer. The top layer is a monostratified plastics foam 10–30 mm thick and having a compression stiffness of 0.20–0.50 kgf/cm$^2$ (when compressed to 25% of a free volume according to JIS K-6767) and a repelling elasticity of 40–60% (according to JIS K-6401), the middle layer is a monostratified or multistratified plastics foam 15–50 mm thick as a whole and having an average 25%-compression stiffness of 1.0–4.0 kgf/cm$^2$, and the bottom layer also is a monostratified or multistratified plastics foam 50–175 mm thick as a whole and having an average 25%-compression stiffness of 0.040–0.068 kgf/cm$^2$ and a repelling elasticity of 35–50% as a whole. A total thickness of the top layer and the middle layer is smaller than the thickness of the bottom layer. The term 'JIS' denotes the Japanese Industrial Standards.

The landing mat as summarized above may be used in a first or second manner respectively shown in FIG. 3*a* or FIG. 3*b*. In the first manner of use, a final product of the so-called 'tarpaulin cover type' will be provided wherein the three layers form an integral mat 'A' wrapped with a cover sheet 4. In the second manner of use, the middle and bottom layers are united to form a core 'B'. This core is also wrapped with the cover sheet 4 to prepare the so-called under mat 'A1'. A carpet 5 is bonded to the upper face of the top layer 1 or 11 to give a large top mat 'A2'. The top and under mats 'A2' and 'Al' will separably be combined with each other and one over another, thereby providing another final product of the so-called 'over mat type'.

DETAILED DESCRIPTION OF THE INVENTION AND THE PREFERRED EMBODIMENTS THEREOF

Figure 1:
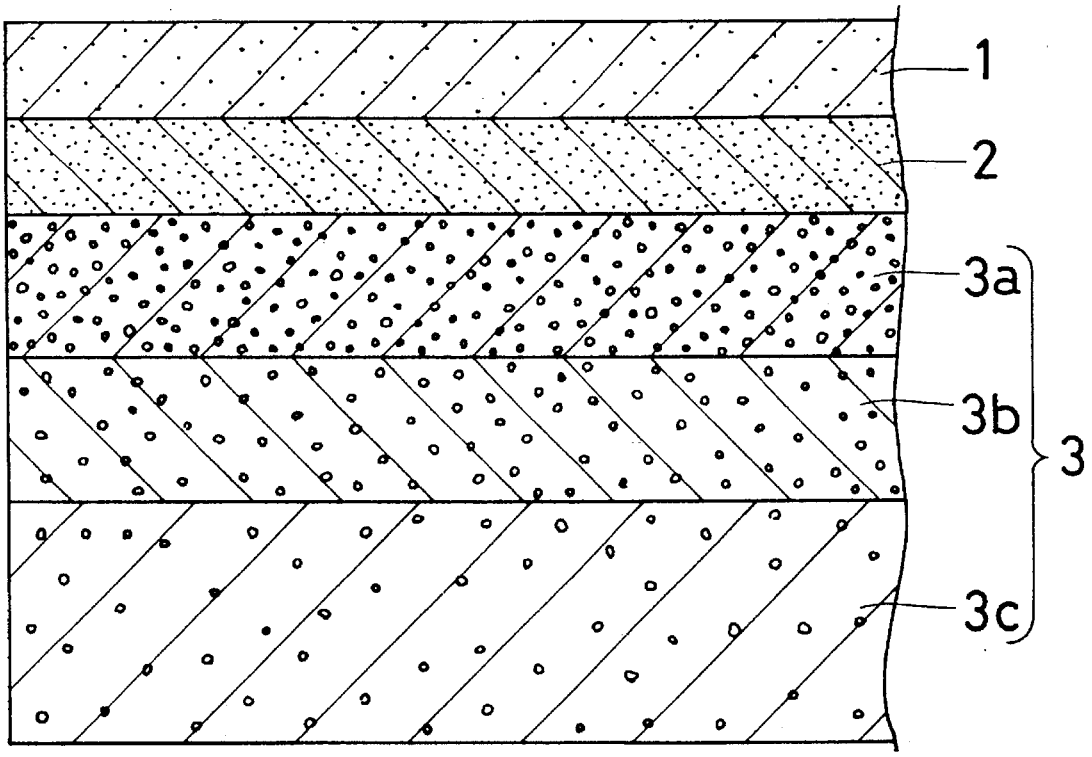
FIG. 1 is a cross section of a landing mat provided in a first embodiment.

Now, the present invention will be detailed referring to some preferable embodiments shown in the drawings.

TOP LAYER AS PRIMARY CUSHION

Figure 2:
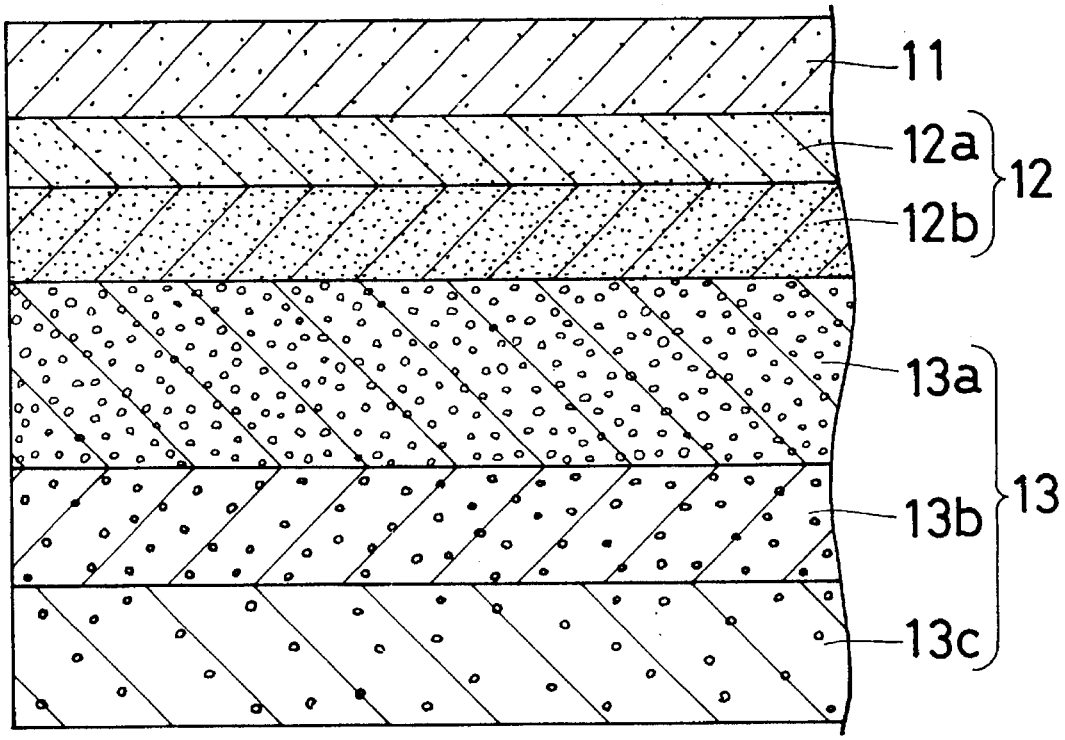
FIG. 2 is a cross section of another landing mat in a second embodiment.
Figure 3A:
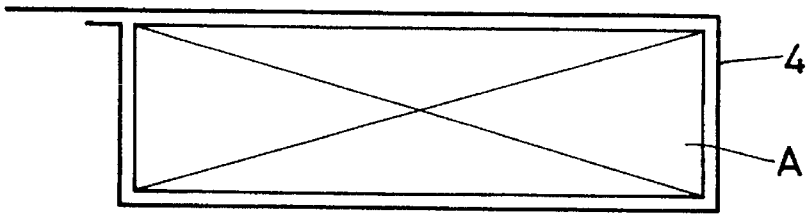
FIG. 3*a* shows a first manner of using the landing mat shown in FIG. 1 or 2.
Figure 3B:
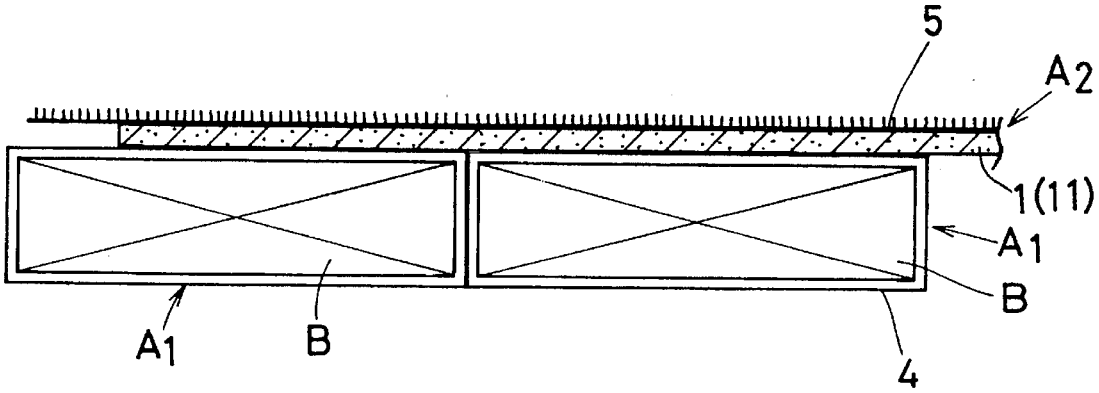
FIG. 3*b* shows a second manner of using the mat shown in FIG. 1 or 2.

In both the embodiments shown in FIGS. 1 and 2, the uppermost layer is a top layer 1 or 11 of a monostratified plastic foam, serving as a primary cushion.

The top layer 1 or 11 is adapted to primarily receive an initial impact of gymnasts landing on the mat so that they can have a feeling of soft landing.

Therefore, the top layer must be of a medium hardness, and its thickness and repelling elasticity must be included within proper ranges.

If the compression stiffness of the top layer is lower than 0.20 kgf/cm$^2$ (when compressed by 25% according to JIS K-6767), the gymnasts will feel unpleasant as if having landed directly on a middle layer relatively rigid to stabilize their posture. However, a compression stiffness higher than 0.50 kgf/cm$^2$ will also be of a poor capability of absorbing the gymnasts' shock. As will be detailed later, the most preferable range of the stiffness is not of an absolute nature but will depend on the kind of materials forming the top layer.

If the top layer is thinner than 10 mm, then the gymnasts will feel unpleasant as if having landed directly on a hard ground, similarly to the case of an excessively soft top layer. If contrarily the top layer is thicker than 30 mm, then their feet will sink unevenly and it will be difficult for them to stabilize posture on the mat. A preferable range of the thickness of top layer is thus from 15 to 25 mm.

With a repelling elasticity (as defined in JIS K-6401) lower than 40%, the gymnasts will feel unpleasant as if having landed on an unflat and unreliable plane. The elasticity above 60% will however make difficult the instantaneous posture stabilization on the mat. A preferable range of the repelling elasticity is therefore from about 45 to 55%.

Any plastics foam meeting the above requirements may form the top layer. Preferable examples of the foam researched by us are: a foam of copolymer ('EVA') of ethylene and vinyl acetate; and a compressed foam of polyurethane. The proper expansion ratio to EVA foam is from 10 to 20, whilst that ratio is 30 for the polyurethane foam hot compressed to one third to one eighth of an original volume. Compression stiffness of the former foam is preferably from about 0.40 to 0.50 kgf/cm$^2$, and that of the latter foam is preferably about 0.20 to 0.30 kgf/cm$^2$.

MIDDLE LAYER FOR POSTURE STABILIZATION

A middle layer 2 or 12 is disposed below the top layer 1 or 11, respectively. These layers will be formed integral with each other in the tarpaulin cover type, though separated in the over mat type.

The middle layer 2 or 12 functions as a considerably rigid internal base for supporting the feet of landing gymnasts and assisting them to easily take a right posture. Dynamic loads of gymnasts will be distributed through the middle layer evenly over a wide area of lower or bottom layer.

The middle layer 2 or 12 may either be a monostratified plastics foam as shown in FIG. 1, or a multistratified composed of a first sublayer or strata 12*a* and a second strata 12*b* as shown in FIG. 2. Alternatively, three or more such strata may constitute the middle layer.

In any case, the middle layer has to be 15–50 mm thick as a whole and have an average compression stiffness of 1.0–4.0 kgf/cm$^2$. The repelling elasticity of the middle layer may not be restricted to any value if the stiffness falls within this range.

If the middle layer is thinner than 15 mm, then it will not be capable of supporting the feet of landing gymnasts and assisting them to easily take a right posture. A thickness greater than 50 mm is however not desirable, because an excessive volume occupied by the middle layer reduces a space to be reserved for a bottom layer in this composite mat. A preferable range of the thickness of the middle layer is from about 20–35 mm.

Compression stiffness is one of the important parameters determining the performance of the middle layers 2 and 12. An average compression stiffness lower than 1.0 kgf/cm$^2$ will render it difficult for gymnasts to stabilize their posture after having landed. With an extremely hard middle layer having the stiffness higher than 4.0 kgf/cm$^2$, the landing gymnasts will however feel pain in their feet. Thus, a preferable range of said stiffness is from 1.5 to 3.5 kgf/cm$^2$, for safe landing.

In a case wherein the middle layer is of a composite structure as shown in FIG. 2, the upper stratum thereof 12*a* is designed softer than the lower one 12*b* . For example, the upper stratum 12*a* may be a plastics foam 10–20 mm thick and having a compression stiffness of 0.7–2.0 kgf/cm$^2$, with the lower stratum being the same or a different plastics foam 15–25 mm thick and having a stiffness of 2.0–4.0 kgf/cm$^2$.

The plastics foam as the middle layer 2 or 12 may be an EVA foam having an average expansion ratio of 3–15, and more preferably of 5–11, whether or not multi-stratified. A low expansion-rate polyethylene foam or a polystyrol foam may substitute for the EVA foam.

BOTTOM LAYER AS MAIN CUSHION

A bottom layer 3 or 13 is secured to a lower face of the middle layer 2 or 12, respectively.

The bottom layer mainly contributes to a lower FO-max protecting the landing gymnasts from being injured.

Thus, a soft material is used to form the bottom layer of a thickness greater than a total thickness of the top and middle layers. Further, the material must be of a relatively low repelling elasticity of 50% or less not to lower the posture stabilization.

In detail, the material must be a plastic foam whose overall thickness and average compression stiffness are 50–175 mm in its entirety and 0.040–0.060 kgf/cm$^2$, respectively. A preferable overall repelling elasticity of said material is 35–50%.

A bottom layer thinner than 50 mm will render poor the shock absorbability and cannot meet the new FIG standard of FO-max, even if the total thickness of the landing mat is made smallest to be 100 mm. On the other hand, a bottom layer thicker than 175 mm will render poor the posture stabilizability, because the thickness of top layer 1 or 11 and middle layer 2 or 12 is reduced to an undesirable extent even if the overall thickness of the landing mat is made greatest to be 200 mm.

The most preferable thickness of the bottom layer 3 or 13 is not constant but depends on the overall thickness of the landing mat. For example, the former may be 60–90 mm for the latter of 100–120 mm, 80–130 mm for the latter of 150 mm, and 120–170 mm for the latter of 200 mm.

Compression stiffness is the most important factor determining the characteristic of the bottom layer. If the overall compression stiffness of the bottom layer is lower than 0.040 kgf/cm$^2$, then the landing gymnasts will feel unpleasant as if having landed directly on a hard floor. An excessive compression of the mat will not meet the low standard of S-ein, thereby impairing the posture stabilizing property. However, a compression stiffness higher than 0.060 kgf/cm$^2$ failing to meet the FO-max standard will cause a poor capability of absorbing the gymnasts' shock. In such a case, they will get hurt in the leg or foot and feel pain in their knees. Thus, the most preferable range is from 0.045 to 0.055 kgf/cm$^2$.

If the repelling elasticity affecting the posture stabilizability is designed lower than 35%, the gymnasts will feel unpleasant as if having landed directly on a hard floor. However, the elasticity higher than 50% will make difficult the instantaneous posture stabilization on the landing mat, because it will repel upwards the gymnasts. A preferable range of the repelling elasticity is therefore from about 42 to 48%.

FIGS. 1 and 2 show an example of preferable bottom layer composed of several strata of different physical properties. In this case, the bottom layer consists of the first or uppermost stratum 3*a* or 13*a*, the second or intermediate stratum 3*b* or 13*b* and the third or lower-most stratum 3*c* or 13*c*. Alternatively, two, four or more strata may construct the bottom layer.

Compression stiffness of the uppermost stratum 3*a* or 13*a* is 0.050–0.080 kgf/cm$^2$, while those of intermediate stratum 3*b* or 13*b* and lowermost stratum 3*c* or 13*c* being 0.030–0.060 kgf/cm$^2$ and 0.020–0.045 kgf/cm$^2$, respectively. The difference in compression stiffness between two adjacent strata may be designed to be 0.030 kgf/cm$^2$ or less, or more desirably 0.005–0.020 kgf/cm$^2$.

Examples of soft plastics foams that may be used to prepare the bottom layer 3 or 13 of the described characteristics include polyurethane foams each having a density of 15–50 kg/m$^3$ so as to provide said layer with an overall density of 25–40 kg/m$^3$.

The strata are bonded one to another using an adhesive to construct the bottom layer, which in turn is similarly bonded to the middle layer 2 or 12. The adhesive may be a urethane-based, acrylic-based or vinyl acetate-based one or the like adhesive.

EXAMPLES

The materials used to prepare the top, middle and bottom layers were as follows as listed in Table 2.

TABLE 2

| | Materials of Layers | | | | | | | | |
|---|---|---|---|---|---|---|---|---|---|
| | Layers | | | | | | | | |
| | Top | | Middle | | | Bottom | | | |
| Foams | EVA (I) | ure. compr. | EVA (II) | EVA (III) | EVA (IV) | ure. (I) | ure. (II) | ure. (III) | ure. (IV) |
| Comp. stiff. | 0.46 | 0.25 | 3.4 | 0.9 | 2.2 | .066 | .047 | .041 | .034 |
| Repel. elas. | 54.3 | 48.0 | 17.8 | 32.6 | 25.0 | 44.6 | 43.5 | 48.9 | 43.5 |
| Density (kg/cubic m) | 70 | 150 | 170 | 70 | 160 | 31 | 24 | 30 | 20 |
| Expans. ratio | 15 | — | 5 | 15 | 7 | 32 | 42 | 33 | 50 |
| Perman. strain (%) | 3.3 | 1.2 | 5.5 | 2.6 | 2.4 | .28 | .63 | .22 | .35 |
| Tensile strength | 10 | 6.6 | 14 | 9.1 | 16 | .98 | .98 | .91 | .92 |
| Elong-ation (%) | 200 | 250 | 100 | 180 | 130 | 130 | 163 | 180 | 200 |

Notes:
(1) 'ure. compr.' denotes an urethane foam (III) whose thickness of 100 mm was compressed to 20 mm.
(2) 'Perman. strain' denotes a permanent strain remaining in the foam which was compressed at a temperature of 20 degrees centigrade for 22 hours, according to JIS K-6767.
(3) 'ure.' denotes urethane.
(3) 'Comp. stiff.' denotes a compression stiffness (kgf/sq. cm) observed at 25% compression also according to JIS K-6767.
(4) 'Repel. elas.' denotes a repelling elasticity (%) of specimens 20 mm thick for the top and middle layers and specimens 50 mm thick for the bottom layer, measured according to JIS K-6401.
(5) Tensile strength (kgf/sq. cm) and elongation were measured according to JIS K-6767.

EXAMPLE-1 TO EXAMPLE-3

The materials listed in Table 2 were used to form strata and layers bonded to each other, in combination as shown in Table 3 and in FIG. 1, so as to prepare three examples of the landing mat. Examples-1 to -3 were of thickness of 120 mm, 150 mm and 200 mm, respectively.

TABLE 3

| | Examples of Landing Mats | | |
|---|---|---|---|
| | Example-1 | Example-2 | Example-3 |
| Layers | materl. thick. | materl. thick. | materl. thick. |
| Top | EVA(I) 20 mm | EVA(I) 20 mm | EVA(I) 20 mm |
| Middle | EVA(II) 20 mm | EVA(II) 20 mm | EVA(II) 20 mm |
| Bottom | | | |
| 1st str. | ure.(I) 30 mm | ure.(I) 30 mm | ure.(I) 50 mm |
| 2nd str. | ure.(III) 20 mm | ure.(III) 30 mm | ure.(II) 60 mm |
| 3rd str. | ure.(IV) 30 mm | ure.(IV) 50 mm | ure.(IV) 50 mm |

Notes:
'materl.' denotes materials.
'str.' denotes strata.

EXAMPLE-4 to EXAMPLE-6

The materials listed in Table 2 were used to form strata and layers bonded to each other, in combination as shown in Table 4 and in FIG. 2, so as to prepare three further examples of the landing mat. Examples-4 to -6 were of thickness of 120 mm, 150 mm and 200 mm, respectively.

TABLE 4

| | Further Examples of Landing Mats | | |
|---|---|---|---|
| | Example-4 | Example-5 | Example-6 |
| Layers | materl. thick. | materl. thick. | materl. thick. |
| Top | ure. comp. 20 mm | ure. comp. 20 mm | ure. comp. 20 mm |
| Middle | | | |
| 1st str. | EVA (III) 15 mm | EVA (III) 15 mm | EVA (III) 15 mm |
| 2nd str. | EVA (IV) 20 mm | EVA (IV) 20 mm | EVA (IV) 20 mm |
| Bottom | | | |
| 1st str. | ure.(I) 35 mm | ure.(I) 40 mm | ure.(I) 40 mm |
| 2nd str. | ure.(II) 30 mm | ure.(II) 25 mm | ure.(II) 50 mm |
| 3rd str. | — | ure.(IV) 30 mm | ure.(IV) 55 mm |

Notes:
'ure. comp.' denotes urethane foams compressed.
'str.' denotes strata.

REFERENCE-1

The materials listed in Table 5 were used to form first to fifth layers bonded to each other, so as to prepare mat units as shown in FIG. 1 of the Japanese Utility Model Publication No. 4-34845. Two mat units thus prepared were laid one on another to provide a landing mat 120 mm thick.

EVALUATION AND COMPARISON OF PERFORMANCE

Each of the Examples-1 to -6 and Reference-1 were wrapped with a cover sheet which comprised a synthetic fiber backing cloth coated with polyvinyl chloride resin. These landing mats of the tarpaulin cover type were tested according to the FIG standard method, to measure FO-max, S-ein and S-ruck.

TABLE 5

| | Reference | | | | |
|---|---|---|---|---|---|
| Layers | 1st | 2nd | 3rd | 4th | 5th |
| Foams | PE | PE | PE | urethane | urethane |
| Thickness | 10 mm | 15 mm | 5 mm | 15 mm | 15 mm |
| Expans. ratio | 30 | 30 | 15 | 20 | 40 |
| Density (kg/cubic m) | 30 | 30 | 70 | 50 | 25 |
| Comp. stiff. | 0.42 | 0.42 | 0.86 | 15(*) | 15(*) |
| Tensile strength | 3 | 3 | 6.2 | 0.7 | 0.8 |
| Repelling elas. | 47 | 47 | 40 | 45 | 40 |
| Perman. strain (%) | 9.1 | 9.1 | 6.4 | 3 | 5 |
| Elong-ation (%) | 120 | 120 | 170 | 150 | 150 |

Notes:
(1) 'PE' denotes a polyethylene foam.
(2) '(*)' denotes compression stiffness represented in kg/314 sq. cm.

Data obtained by the test are listed in Table 6, in comparison with the new FIG standards.

As seen in Table 6, all the samples of the landing mat provided herein met the new FIG standards, regardless of their thickness, and proved superior to the prior art mats with respect to safety and posture stabilizability for the landing gymnasts.

In summary, the present invention offers a landing mat of a novel and excellent type that the new FIG provisions of FO-max, S-ein and S-ruck are satisfied to ensure improved safety and posture stabilizability, whereby any gymnasts can perform certain extremely difficult exercises such as called ultra-D or ultra-E.

TABLE 6

| Examples/ Refer. | Test Result | | | | | |
|---|---|---|---|---|---|---|
| | FO-max (N) | | S-ein (mm) | | S-ruck (mm) | |
| (mm) | meas. | FIG | meas. | FIG | meas. | FIG |
| Ex. 1 (120) | 3870.6 | 4000 | 87.8 | 105 | 58.4 | 100 |
| Ex. 2 (150) | 3209.6 | 3500 | 96.7 | 105 | 61.3 | 100 |
| Ex. 3 (200) | 2946.5 | 3000 | 101.0 | 110 | 89.2 | 90 |
| Ex. 4 (120) | 3951.8 | 4000 | 82.8 | 105 | 67.8 | 100 |
| Ex. 5 (150) | 3482.8 | 3500 | 94.5 | 105 | 66.2 | 100 |
| Ex. 6 (200) | 2893.2 | 3000 | 100.9 | 110 | 83.2 | 90 |
| Ref. 1 (120) | 4450.8 | 4000 | 81.7 | 105 | 59.5 | 100 |

Notes:
'meas.' denotes data obtained by measurement.
'FIG' denotes the new FIG standards.
'(mm)' denotes thickness in mm.

What is claimed is:

1. A landing mat for gymnasts comprising:

a top layer serving as a primary cushion;

a middle layer disposed under the top layer so as to stabilize the posture of the gymnasts landing on their feet;

a bottom layer serving as a main cushion and secured to a lower surface of the middle layer;

the top layer being a monostratified plastics foam 10–30 mm thick and having a 25%-compression stiffness of 0.20–0.50 kgf/cm$^2$ (according to JIS K-6767) and a repelling elasticity of 40–60% (according to JIS K6401);

the middle layer being a stratified plastics foam 15–50 mm thick as a whole and having an average compression stiffness of 1.0–4.0 kgf/cm$^2$; and the bottom layer being a stratified plastics foam 50–175 mm thick as a whole and having an average 25%-compression stiffness of 0.040–0.060 kgf/cm$^2$ and a repelling elasticity of 35–50% as a whole, wherein a total thickness of the top layer and the middle layer is smaller than the thickness of the bottom layer.

2. A landing mat as defined in claim 1, wherein the top layer consists of a compressed polyurethane foam having a compression stiffness of 0.20–0.30 kgf/cm$^2$.

3. A landing mat as defined in claim 1, wherein the top layer consists of a foam of an ethylene-vinyl acetate copolymer, the foam having an expansion ratio of 10–20 and a compression stiffness of 0.040–0.050 kgf/cm$^2$.

4. A landing mat as defined in claim 1, wherein the middle layer consists of a foam of an ethylene-vinyl acetate copolymer, the foam having an expansion ratio of 5–15.

5. A landing mat as defined in claim 4, wherein the middle layer consists of an upper stratum having a compression stiffness of 0.7–2.0 kg/cm$^2$ and a lower stratum having a compression stiffness of 2.0–4.0 kgf/cm$^2$.

6. A landing mat as defined in claim 1, wherein the bottom layer consists of a polyurethane foam having an average density of 25–40 kg/m$^3$.

7. A landing mat as defined in claim 6, wherein the bottom layer consists of at least two strata including an uppermost stratum and a lowermost stratum such that the compression stiffness of each stratum gradually decreases towards the lowermost stratum.

8. A landing mat as defined in claim 7, wherein a difference in the compression stiffness between the adjacent upper and lower strata is 0.030 kgf/cm$^2$ or less.

9. A landing mat as defined in claim 4, wherein the bottom layer consists of a polyurethane foam having an average density of 25–40 kg/m$^3$.

10. A landing mat as defined in claim 9, wherein the bottom layer consists of at least two strata including an uppermost stratum and a lowermost stratum such that the compression stiffness of each stratum gradually decreases towards the lowermost stratum, and wherein a difference in the compression stiffness between the adjacent upper and lower strata is 0.030 kgf/cm$^2$ or less.

11. A landing mat as defined in claim 5, wherein the bottom layer consists of a polyurethane foam having an average density of 25–40 kg/m$^3$.

12. A landing mat as defined in claim 11, wherein the bottom layer consists of at least two strata including an uppermost stratum and a lowermost stratum such that the compression stiffness of each stratum gradually decreases towards the lowermost stratum, and wherein a difference in the compression stiffness between the adjacent upper and lower strata is 0.030 kgf/cm$^2$ or less.

* * * * *